US009709338B2

(12) United States Patent
Feuerecker

(10) Patent No.: US 9,709,338 B2
(45) Date of Patent: Jul. 18, 2017

(54) HEAT EXCHANGER

(71) Applicant: Behr GmbH & Co. KG, Stuttgart (DE)

(72) Inventor: Günther Feuerecker, Stuttgart (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 632 days.

(21) Appl. No.: 14/036,452

(22) Filed: Sep. 25, 2013

(65) Prior Publication Data

US 2014/0083665 A1 Mar. 27, 2014

(30) Foreign Application Priority Data

Sep. 25, 2012 (DE) ..... 10 2012 217 340

(51) Int. Cl.
*F28F 1/12* (2006.01)
*F28F 9/02* (2006.01)
*F28D 1/053* (2006.01)

(52) U.S. Cl.
CPC ..... *F28F 1/12* (2013.01); *F28D 1/05375* (2013.01); *F28F 9/027* (2013.01); *F28F 9/0209* (2013.01)

(58) Field of Classification Search
CPC ..... F28D 1/00; F28F 1/12; F28F 1/42; F28F 9/22; F28F 9/26; F25B 39/02; F25B 39/028

(Continued)

(56) References Cited

U.S. PATENT DOCUMENTS 1,313,518 A * 8/1919 Clark ..... F28F 9/0212 165/174
1,684,083 A * 9/1928 Bloom ..... F25B 39/02 165/174

(Continued)

FOREIGN PATENT DOCUMENTS

CN 201 909 576 U 7/2011
DE 10 2005 004 284 A1 8/2005

(Continued)

OTHER PUBLICATIONS

German Search Report, Application No. DE 10 2012 217 340.4, Aug. 9, 2013, 5 pgs.

(Continued)

*Primary Examiner* — Len Tran
*Assistant Examiner* — Gustavo Hincapie Serna
(74) *Attorney, Agent, or Firm* — Paul D. Strain, Esq.; Strain & Strain PLLC

(57) ABSTRACT

Heat exchanger having a block of flat tubes arranged parallel to one another and having fins arranged between the flat tubes, wherein the flat tubes form flow ducts through which a refrigerant can flow, and a coolant can flow around the flat tubes, wherein the flat tubes are in fluid communication, at end regions, with collecting tanks, wherein the refrigerant can be made to flow into an inflow region of a collecting tank in fluid communication with at least one of the flow ducts, wherein the inflow region has a line, which extends through the inflow region, for inflow of the refrigerant, wherein a refrigerant passage is provided from the line to the collecting tank inflow region, said refrigerant passage arranged in the central region of the collecting take inflow region, wherein the central region is in relation to a direction oriented perpendicularly to a plane of the flat tubes.

15 Claims, 1 Drawing Sheet

(58) Field of Classification Search
USPC ..... 165/173, 174; 62/525, 527
See application file for complete search history.

(56) References Cited

U.S. PATENT DOCUMENTS

| | | | | | |
|---|---|---|---|---|---|
| 2,942,858 | A * | 6/1960 | Stoneburner | F28D 7/12 | 165/142 |
| 4,302,949 | A * | 12/1981 | Trimboli Longhetto | F25B 9/04 | 62/235.1 |
| 4,557,324 | A * | 12/1985 | Kondo | F25B 39/02 | 165/174 |
| 5,806,586 | A * | 9/1998 | Osthues | F28F 9/0273 | 165/153 |
| 7,143,605 | B2 * | 12/2006 | Rohrer | F25B 5/02 | 165/174 |
| 7,398,819 | B2 * | 7/2008 | Taras | F25B 39/028 | 165/150 |
| 7,946,036 | B2 * | 5/2011 | Beamer | F28D 1/05366 | 29/890.03 |
| 7,967,060 | B2 * | 6/2011 | Trumbower | F25B 39/028 | 165/174 |
| 8,171,987 | B2 * | 5/2012 | Jiang | F25B 39/028 | 165/174 |
| 2006/0201198 | A1 * | 9/2006 | Nishino | F25B 39/028 | 62/525 |
| 2010/0089095 | A1 * | 4/2010 | Macri | F25B 39/028 | 62/525 |
| 2010/0089559 | A1 * | 4/2010 | Gorbounov | F25B 39/028 | 165/174 |
| 2011/0017438 | A1 * | 1/2011 | Huazhao | F25B 39/028 | 165/174 |
| 2011/0127023 | A1 * | 6/2011 | Taras | F28F 9/0273 | 165/173 |
| 2011/0139422 | A1 * | 6/2011 | Oddi | F28F 9/027 | 165/173 |
| 2011/0203308 | A1 * | 8/2011 | Chiang | F28F 9/0273 | 62/498 |
| 2011/0240276 | A1 * | 10/2011 | Wintersteen | F28D 1/05383 | 165/173 |
| 2011/0253353 | A1 * | 10/2011 | Tokizaki | F25B 39/04 | 165/173 |
| 2012/0061064 | A1 * | 3/2012 | Stromer | F28D 9/005 | 165/177 |

FOREIGN PATENT DOCUMENTS

| | | | |
|---|---|---|---|
| EP | 1 548 380 | A2 | 6/2005 |
| EP | 2 278 246 | A2 | 1/2011 |
| EP | 2 299 224 | A2 | 3/2011 |
| EP | 2 362 176 | A2 | 8/2011 |
| EP | 2 375 209 | A2 | 10/2011 |
| JP | H06-159983 | A | 6/1994 |
| JP | 2007-113795 | A | 5/2007 |
| WO | WO 00/20816 | A1 | 4/2000 |
| WO | WO 2010/005676 | A2 | 1/2010 |
| WO | WO 2011/157063 | A1 | 12/2011 |
| WO | WO 2012/034438 | A1 | 3/2012 |

OTHER PUBLICATIONS

European Search Report, Application No. 13182842.8, Aug. 7, 2014, 9 pgs.

* cited by examiner

HEAT EXCHANGER

CROSS-REFERENCE TO RELATED PATENT APPLICATIONS

This application is based upon and claims the benefit of priority from prior German Patent Application No. 10 2012 217 340.4, filed Sep. 25, 2012, the entire contents of which are incorporated herein by reference in their entirety.

TECHNICAL FIELD

The invention relates to a heat exchanger having a block of flat tubes arranged parallel to one another and having fins arranged between the flat tubes, wherein the flat tubes form flow ducts through which a refrigerant can flow, and a coolant can flow around the flat tubes, wherein the flat tubes are in fluid communication, at their end regions, with collecting tanks, wherein the refrigerant can be made to flow into an inflow region of a collecting tank which is in fluid communication with at least one of the flow ducts.

PRIOR ART

Evaporators in air-conditioning systems of motor vehicles are often traversed by a flow of refrigerant. Here, the refrigerant, which is present in a two-phase state, is changed completely into a gaseous phase in the evaporator.

At the time at which it is introduced into the evaporator, the refrigerant has both a liquid and also a gaseous phase.

In the use of flat-tube evaporators, it is advantageous for the two phases to be distributed uniformly across the flat tubes in order thereby to attain a uniform action of the evaporator. If there is an uneven distribution, for example, warm zones arise in the regions to which less liquid refrigerant is supplied. Said warm zones can adversely affect the efficiency of the evaporator.

To attain a uniform distribution of the refrigerant, various methods are known in the prior art.

DE 10 2005 004 284 A1, for example, discloses a flat-tube evaporator which, on one of its laterally arranged collecting tanks, has an inflow opening on the lateral side surface oriented parallel to the plane of the flat tubes, through which inflow opening the refrigerant can flow into the evaporator. Here, the refrigerant can distribute freely in the inflow region and flows from there into the flat tubes.

US 2006/0201198 A1 discloses a flat-tube evaporator which has a nozzle on the side wall, oriented parallel to the plane of the flat tubes, of the collecting tank. By means of the nozzle, it is attempted to ensure as uniform an inflow of the refrigerant as possible over the entire length of the collecting tank.

A disadvantage of this is that, in particular in the case of large mass flows or high vapor flow speeds, a considerable decrease in static pressure takes place in the inlet region owing to the Bernoulli effect. Said decrease may under some circumstances be so great that the first flat tubes arranged downstream of the nozzle are not impinged on by refrigerant. In extreme cases, a reverse flow of the refrigerant may even occur in said flat tubes. This likewise leads to the formation of warm zones which adversely affect the efficiency of the evaporator.

EP 1 548 380 A2 discloses an injection line which is led into the collecting tank and which, along its extent in the collecting tank, has a multiplicity of openings which are preferably oriented in a common direction. The refrigerant flows through said injection line and emerges from the multiplicity of openings so as to be distributed uniformly in the collecting tank.

Here, the openings point in a direction facing away from the inlet of the flat tubes.

A disadvantage here is that, in particular in the case of high mass flow rates, it must be assumed that the individual openings are impinged on with a different vapor fraction of the refrigerant, which leads to a severely uneven distribution in the collecting tank. This rather intensifies the problems such as the generation of warm zones.

It is a disadvantage of the devices according to prior art that an even distribution of the two-phase refrigerant across the collecting tank is not attained either in the case of low mass flow rates or in the case of high mass flow rates.

Presentation of the Invention, Problem, Solution, Advantages

Therefore, the problem addressed by the present invention is that of providing a heat exchanger which permits a uniform distribution of the inflowing refrigerant across the inflow region both in the case of high mass flow rates and also in the case of low mass flow rates.

The problem addressed by the present invention is solved by means of a heat exchanger having the features according to claim 1.

An exemplary embodiment of the invention concerns a heat exchanger having a block of flat tubes arranged parallel to one another and having fins arranged between the flat tubes, wherein the flat tubes form flow ducts through which a refrigerant can flow, and a coolant can flow around the flat tubes, wherein the flat tubes are in fluid communication, at their end regions, with collecting tanks, wherein the refrigerant can be made to flow into an inflow region of a collecting tank which is in fluid communication with at least one of the flow ducts, wherein the inflow region has a line, which extends through the inflow region, for the inflow of the refrigerant, wherein a refrigerant passage is provided from the line to the inflow region of the collecting tank, said refrigerant passage being arranged in the central region of the inflow region of the collecting tank, wherein the central region is in relation to a direction oriented perpendicularly to a plane of the flat tubes.

Via the line which runs in the interior of the collecting tank, it is made possible for the refrigerant to be made to flow into the inflow region of the collecting tank at a defined point. In this way, it is possible to generate a more uniform distribution of the refrigerant in the inflow region of the collecting tank. By means of a more uniform distribution, the efficiency of the heat exchanger can be increased.

The arrangement of the refrigerant passage in the central region of the inflow region is particularly conducive to a uniform distribution of the refrigerant in the inflow region, because the flow path to the in each case furthest remote flat tubes is the same.

A flat tube is composed of substantially two opposite large flat side surfaces which are connected to one another via two narrow sides. The plane of the flat tubes therefore designates a plane which runs parallel to the large flat side surfaces of the flat tubes.

It is also advantageous for the line to extend substantially perpendicularly to a plane of the flat tubes.

In one advantageous refinement of the invention, it is provided that the line extends substantially over half of the length of the inflow region or extends over substantially the entire length of the inflow region.

If the line extends over the entire length of the inflow region, it is attained that the barrier effect, generated by the line, for the refrigerant that is made to flow into the inflow region is uniform over the entire length of the inflow region. This promotes a uniform distribution of the refrigerant in the inflow region. Here, the barrier effect is generated by the line, which opposes the free flow of the refrigerant within the inflow region.

If the line extends over half of the length of the inflow region, material costs can be reduced. Furthermore, an embodiment with a line which extends only over half of the length of the inflow region may be advantageous in particular if the spatial conditions do not allow the line to extend over the full length.

It is also expedient for the flow emerging from the refrigerant passage to be oriented perpendicularly to the extent of the line.

By means of a flow out of the refrigerant passage perpendicular to the extent of the line, it is attained that the refrigerant flows preferentially to one of the walls of the inflow region before flowing onward into one of the flat tubes. A more uniform distribution of the refrigerant in the inflow region is attained in this way.

In a particularly expedient refinement, it may be provided that the refrigerant passage is arranged at an angle with respect to the main flow direction of the flat tubes and in the plane of the flat tubes, wherein the angle lies in a range from 140° to 220°, preferably in a range from 160° to 200°, and preferably corresponds to approximately 180°.

By means of an arrangement of the refrigerant passage at a predefined angle with respect to the main flow direction of the flat tubes and in the plane of the flat tubes, it can be attained that the refrigerant does not flow directly into the flat tubes but rather is distributed along the inflow region beforehand. A more uniform distribution of the refrigerant in the inflow region is attained in this way.

It is also advantageous for the refrigerant passage to be formed by an opening.

By means of the provision of only one opening for the refrigerant passage, it is possible to avoid incorrect distributions in the inflow region, in particular if said one opening is arranged in the central region of the inflow region. In the case of low mass flow rates, the refrigerant is thus distributed more uniformly over the entire length of the inflow region. In the case of high mass flow rates, the one opening which is positioned in the interior of the inflow region, and which advantageously permits a flow out of the line in a plane of the flat tubes, serves to prevent the refrigerant from being able to flow beyond individual flat tubes, such as may occur for example in the case of an inflow simply through a lateral wall of the collecting tank. In any case, by means of the provision of a single inflow opening, an incorrect distribution of the liquid and vapor fractions is avoided.

In one advantageous refinement of the invention, it is expedient for the refrigerant passage to be formed by a plurality of openings which are arranged adjacent to one another in the direction of extent of the line and which, in a plane of the flat tubes, are arranged at the same angle with respect to the main throughflow direction of the flat tubes or are arranged at individually distinct angles with respect to the main throughflow direction.

A plurality of openings which are arranged directly adjacent one another in a small region of the line may be particularly advantageous for a uniform distribution of the refrigerant in the inflow region. As a result of the arrangement of the plurality of openings in a small region, the advantages associated with a single opening are maintained, whereas an additional advantage lies in the fact that an even more advantageous distribution can be attained by means of a plurality of individually oriented openings.

A small region refers to a region which, in relation to the overall length of the line in the collecting tank, takes up at most approximately one quarter of the line length.

In a particularly expedient refinement of the invention, it is also provided that the outer dimension of the line is in a ratio of 0.25 to 0.5 with respect to the inner dimension of the collecting tank.

The limitation of the outer dimension of the line in relation to the inner dimension of the collecting tank is advantageous because, in this way, it is ensured that adequately large gaps always remain between the line and the inner walls of the collecting tank. If the line were to take up too large a region in relation to the inner dimension of the collecting tank, the line would exert too great a barrier effect on the refrigerant. The inflow of the refrigerant into the flat tubes would thereby be hindered.

In the case of a cylindrical line, the outer dimension would be, for example, the outer diameter.

It is also preferable for a width of the opening of the refrigerant passage or of the openings of the refrigerant passage to be in a ratio of 0.1 to 0.4 with respect to the inner dimension of the collecting tank.

Furthermore, it is advantageous for the opening or the openings of the refrigerant passage to extend over a region of approximately 1% to 25% of the length of the inflow region.

A spatial limitation of the refrigerant passage in relation to the length of the inflow region is advantageous because, in this way, it can be achieved that the refrigerant passage cannot extend over an arbitrarily long part of the inflow region, which would result in disadvantages with regard to the uniform distribution.

In a further exemplary embodiment, it is advantageous for the line to be led through an end surface of the collecting tank into the inflow region, said end surface being arranged parallel to the plane of the flat tubes.

It is advantageous for the line to be led through an end surface, which is arranged parallel to the plane of the flat tubes, of the collecting tank because, within the collecting tank, too, the line runs in a direction of the collecting tank, perpendicular to the plane of the flat tubes. By virtue of the line being led in already in this direction, it is possible to dispense with unnecessary diversion points which can generate undesired pressure losses.

A particularly advantageous exemplary embodiment of the invention provides that the heat exchanger is an evaporator.

Advantageous further refinements of the present invention are described in the subclaims and in the following description of the figures.

BRIEF DESCRIPTION OF THE DRAWINGS

The invention will be explained in detail below on the basis of exemplary embodiments and with reference to the drawings, in which.

PREFERRED EMBODIMENT OF THE INVENTION

Figure 1:
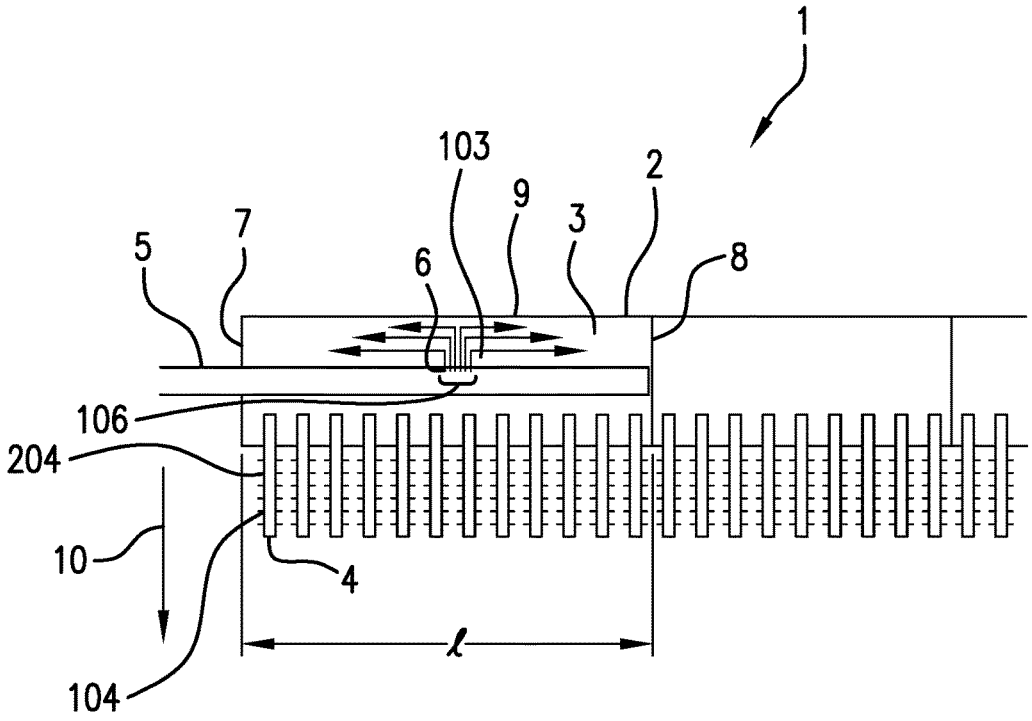
FIG. 1 shows a section through a collecting tank of a heat exchanger, having a line which protrudes into the inflow region and through which the refrigerant is made to flow centrally into the inflow region, having a line which extends along the entire inflow region.

FIG. 1 shows a section through a heat exchanger 1. In detail, FIG. 1 illustrates a section through a collecting tank 2. The heat exchanger 1 has in each case one collecting tank 2, 2 *a* at two opposite sides. The two collecting tanks 2, 2 *a* are connected to one another via the flat tubes 4 which form flow ducts 204 having fins 104. A refrigerant can flow between the collecting tanks 2, 2 *a* via the flat tubes 4.

Figure 2:
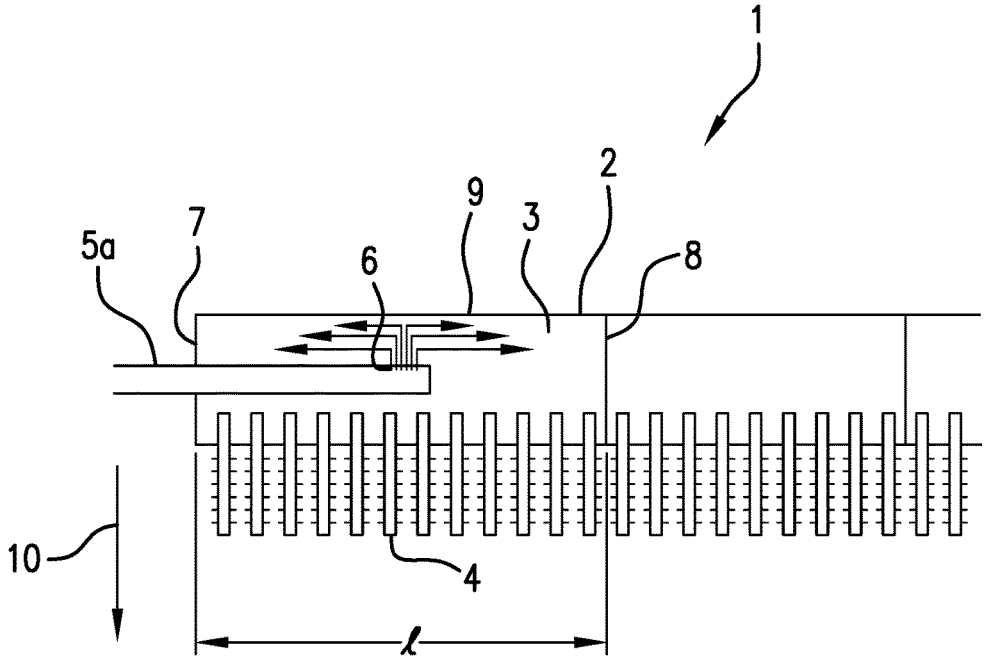
FIG. 2 is an alternative refinement of the heat exchanger as per FIG. 1, with a shortened line.

FIG. 1 and FIG. 2 illustrate in each case only one of the two collecting tanks 2, 2*a*. The collecting tank 2 shown in each case has the inflow region of the heat exchanger 1.

The collecting tank 2 of FIG. 1 is divided into multiple chambers by partitions 8. A refrigerant flowing into the collecting tank 2 can propagate in each case only along one of said chambers before it flows over into the respective second collecting tank 2*a* through the flat tubes 4. The refrigerant is distributed further in said second collecting tank 2*a* and flows via further flat tubes 4 into the next chamber of the collecting tank 2. Said diversion between the first collecting tank 2 and the second collecting tank 2*a* takes place a greater or smaller number of times depending on the length of the collecting tank 2 and a number of partitions 8.

The first chamber of the collecting tank 2 is the inflow region 3 of the heat exchanger 1. In this case, a line extends through the lateral end surface 7, which lies parallel to the plane of the flat tubes, of the collecting tank 2. Said line 5 is in fluid communication with a refrigerant source. The refrigerant flows into the inflow region 3 of the collecting tank 2 via the line 5.

The line 5 shown in FIG. 1 extends over the entire length of the inflow region 3. In the central region 103 of the inflow region 3, the line 5 has a refrigerant passage 6. Via said refrigerant passage 6, the refrigerant that flows via the line into the collecting tank 2 can pass over from the line 5 into the inflow region 3.

The refrigerant passage 6 shown in FIG. 1 is formed by a single opening. Said refrigerant passage permits a flow of the refrigerant from the line 5 into the inflow region 3, which runs parallel to a plane of the flat tubes. The refrigerant passage 6 is positioned on the line 5 such that the refrigerant flows out of the line 5 in the direction of that wall 9 of the collecting tank 2 which is situated opposite the flat tubes 4.

In this way, it is attained that the refrigerant impinges on the wall 9 and is distributed there along the entire inflow region 3 over the length 1. This leads to a uniform distribution of the refrigerant within the inflow region 3. Finally, the refrigerant which is present in substantially uniformly distributed form in the inflow region 3 flows into the flat tubes 4 to the opposite collecting tank 2*a*.

In the exemplary embodiment shown here, there is, in a plane of the flat tubes, an angle of approximately 180° between the opening which forms the refrigerant passage 6 and the main flow opening 10. In alternative embodiments, a different angle may be provided. The refrigerant passage 6 should however in each case be oriented such that the refrigerant is diverted primarily toward that wall 9 of the collecting tank 2 which is situated opposite the flat tubes 4. This contributes to an improved distribution of the refrigerant in the inflow region 3.

In other embodiments, it may likewise be provided that the refrigerant passage is formed not by a single opening but rather by a plurality of small openings. These may be arranged for example in a region in which they are arranged directly adjacent to one another. Said region is situated preferably in the central region of the inflow region as viewed in the direction of extent of the line. A uniform distribution of the refrigerant is promoted by means of an arrangement of the refrigerant passage in the central region of the inflow region.

If the refrigerant passage 6 is formed from a plurality of openings 106, said openings may be oriented either uniformly at the same angle with respect to the main flow direction 10 of the flat tubes and in a plane of the flat tubes, or else may be oriented at individual distinct angles with respect to the main flow direction 10. In the case of the arrangement of multiple openings, too, it is preferable for each of the openings to be oriented such that the refrigerant flows primarily to the wall 9 situated opposite the flat tubes 4. In any case, the refrigerant passage 6 or the plurality of openings is arranged at an angle with respect to the main flow direction of the flat tubes and in the plane of the flat tubes, wherein the angle lies in a range from 140° to 220°, preferably in a range from 160° to 200°, and preferably corresponds to approximately 180°.

FIG. 2 shows an arrangement of a heat exchanger according to the exemplary embodiment of FIG. 1. The reference signs substantially correspond between the two figures. The only difference is the line FIG. 5*a* which, by contrast to FIG. 1, extends not over the entire length 1 of the inflow region 3 but rather projects into the collecting tank 2 over only slightly more than half of the length 1 of the inflow region 3. In FIG. 2, the refrigerant passage 6 is arranged on the end region of the line 5*a*. The possible alternative embodiments already described in FIG. 1 apply with regard to the configuration of the refrigerant passage 6.

A line as shown in FIG. 1 is preferable to a line configuration as shown in FIG. 2. By virtue of the line extending along the entire length 1 of the inflow region 3, it is ensured that all of the refrigerant that flows into the inflow region 3 above the line 5, 5*a* is subject to the same flow resistance.

By means of the line 5, 5*a*, a barrier effect is generated by means of which the flow of the refrigerant from above the line 5, 5*a* to the flat tube 4 is hindered with varying intensity. Within the context of a uniform refrigerant distribution, said barrier effect should be as uniform as possible over the entire length 1 of the inflow region 3.

The invention claimed is:

1. A heat exchanger having a block of flat tubes arranged parallel to one another and having fins arranged between the flat tubes, wherein the flat tubes form flow ducts through which a refrigerant can flow, and a coolant can flow around the flat tubes, wherein the flat tubes are in fluid communication, at their end regions, with collecting tanks, wherein the refrigerant can be made to flow into an inflow region of a collecting tank which is in fluid communication with at least one of the flow ducts, wherein the inflow region has a line, which extends through the inflow region, for the inflow of the refrigerant, wherein the line has a single inflow opening or a plurality of openings grouped together in a central region along the length and the width of the line such that the central region has a length no longer than one quarter of a length of the line in the collecting tank, wherein the line has no further inflow openings outside of the central region, wherein a refrigerant passage is provided from the line to the inflow region of the collecting tank, said refrigerant passage being arranged in the central region of the inflow region of the collecting tank, wherein the central region is in relation to a direction oriented perpendicularly to a plane of the flat tubes, wherein an outer dimension of the line is in a ratio of 0.25 to 0.5 with respect to an inner dimension of the collecting tank.

2. The heat exchanger according to claim 1, wherein the line extends substantially perpendicularly to a plane of the flat tubes.

3. The heat exchanger according to claim 1, wherein the line extends substantially over half of the length of the inflow region or extends over substantially the entire length of the inflow region.

4. The heat exchanger according to claim 1, wherein the flow emerging from the refrigerant passage is oriented perpendicularly to the extent of the line.

5. The heat exchanger according to claim 1, wherein the refrigerant passage is arranged at an angle with respect to the main flow direction of the flat tubes and in the plane of the flat tubes, wherein the angle lies in a range from 140° to 220°.

6. The heat exchanger according to claim 1, wherein the refrigerant passage is formed by an opening.

7. The heat exchanger according to claim 1, wherein the refrigerant passage is formed by a plurality of openings which are arranged adjacent to one another in the direction of extent of the line and which, in a plane of the flat tubes, are arranged at the same angle with respect to the main throughflow direction of the flat tubes or are arranged at individually distinct angles with respect to the main throughflow direction.

8. The heat exchanger according to claim 1, wherein a width of the opening of the refrigerant passage or of the openings of the refrigerant passage is in a ratio of 0.1 to 0.4 with respect to an inner dimension of the collecting tank.

9. The heat exchanger according to claim 1, wherein the opening or the openings of the refrigerant passage extend over a region of approximately 1% to 25% of the length of the inflow region.

10. The heat exchanger according to claim 1, wherein the line is led through an end surface of the collecting tank into the inflow region, said end surface being arranged parallel to the plane of the flat tubes.

11. The heat exchanger according to claim 1, wherein the heat exchanger is an evaporator.

12. The heat exchanger according to claim 1, wherein the refrigerant passage is arranged at an angle with respect to the main flow direction of the flat tubes and in the plane of the flat tubes, wherein the angle lies in a range from 160° to 200°.

13. The heat exchanger according to claim 1, wherein the refrigerant passage is arranged at an angle with respect to the main flow direction of the flat tubes and in the plane of the flat tubes, wherein the angle corresponds to approximately 180°.

14. The heat exchanger according to claim 1, wherein the line has a single inflow opening.

15. The heat exchanger according to claim 1, wherein the line has a plurality of openings grouped together in a central region along the length and the width of the line such that the central region has a length no longer than one quarter of a length of the line in the collecting tank.

* * * * *